US011065173B1

(12) United States Patent
Thorn

(10) Patent No.: US 11,065,173 B1
(45) Date of Patent: Jul. 20, 2021

(54) MASSAGE APPARATUS

(71) Applicant: Jonathan Thorn, Castro Valley, CA (US)

(72) Inventor: Jonathan Thorn, Castro Valley, CA (US)

( * ) Notice: Subject to any disclaimer, the term of this patent is extended or adjusted under 35 U.S.C. 154(b) by 659 days.

(21) Appl. No.: 15/679,582

(22) Filed: Aug. 17, 2017

Related U.S. Application Data

(60) Provisional application No. 62/376,327, filed on Aug. 17, 2016.

(51) Int. Cl.
*A61H 7/00* (2006.01)
*A61H 15/00* (2006.01)

(52) U.S. Cl.
CPC ..... *A61H 7/003* (2013.01); *A61H 7/002* (2013.01); *A61H 7/008* (2013.01); *A61H 15/0092* (2013.01); *A61H 2015/0014* (2013.01); *A61H 2015/0021* (2013.01); *A61H 2015/0042* (2013.01); *A61H 2201/0153* (2013.01); *A61H 2201/1635* (2013.01); *A61H 2201/1654* (2013.01); *A61H 2201/1657* (2013.01); *A61H 2201/1676* (2013.01); *A61H 2205/06* (2013.01); *A61H 2205/10* (2013.01)

(58) Field of Classification Search
CPC ..... A61H 7/003; A61H 7/008; A61H 2201/1635; A61H 2201/1654; A61H 2201/1657; A61H 1/008; A61H 15/00; A61H 2015/0007; A61H 2015/0042; A61H 2201/0107; A61H 2201/0153; A61H 2201/0157; A61H 2201/1253; A61H 2201/1671; A61H 2201/1673; A61H 2201/1685; A61H 15/2015; A61H 7/00
USPC ..... 601/103, 113, 119, 120, 122, 123, 125, 601/128, 129
See application file for complete search history.

(56) References Cited

U.S. PATENT DOCUMENTS

| | | | | |
|---|---|---|---|---|
| 655,490 | A | 8/1900 | Hollem | |
| 923,158 | A | 6/1909 | Egan | |
| D40,158 | S | 7/1909 | Apfel | |
| 1,058,273 | A | 4/1913 | Thompson | |
| 1,815,560 | A | 7/1931 | Gehm | |
| D85,076 | S | 9/1931 | Barker | |
| 2,127,674 | A | 8/1938 | Clarke | |
| 3,856,002 | A * | 12/1974 | Matsumoto | A61H 7/003 601/137 |
| 3,957,039 | A * | 5/1976 | Ehren | A61H 15/0092 601/132 |
| 3,996,929 | A | 12/1976 | Mabuchi | |
| 4,569,336 | A * | 2/1986 | Wheeler | A61H 1/0237 434/255 |
| 4,798,198 | A * | 1/1989 | Wright | A61H 7/003 601/119 |
| 5,117,815 | A | 6/1992 | Gentry et al. | |
| 5,152,281 | A * | 10/1992 | Koll | A61H 15/0092 601/118 |
| D376,853 | S | 12/1996 | Hsia | |

(Continued)

*Primary Examiner* — Tu A Vo
*Assistant Examiner* — Alexander Morales
(74) *Attorney, Agent, or Firm* — Steven R. Vosen

(57) ABSTRACT

An apparatus is provided for massaging having a body with a handle and a distal end, and a rigid support movably attached to the body and having a surface. The apparatus is sized to contact the user between the distal end and the surface. The user may then adjust the a force by moving the handle relative to the surface to apply a force to the user's body.

4 Claims, 10 Drawing Sheets

(56) References Cited

U.S. PATENT DOCUMENTS 6,102,876 A 8/2000 Winger
D463,029 S 9/2002 Collins
6,735,808 B2 5/2004 Chen
7,169,120 B2 1/2007 Murdock et al.
7,572,238 B2 8/2009 Rhoades
8,241,232 B2 8/2012 Sanders
8,262,593 B2 9/2012 Pidcock
8,622,941 B2 * 1/2014 Wu ..... A61H 7/003 601/112
8,727,955 B2 5/2014 Huang
9,615,990 B2 * 4/2017 Turnbow-Faraci .... A61H 7/003
9,616,267 B2 * 4/2017 Sassano ..... A61H 1/0292
2005/0113726 A1 * 5/2005 Prettyman ..... A61H 15/0092 601/119
2007/0129656 A1 * 6/2007 Brooks ..... A61H 7/003 601/135
2007/0161479 A1 * 7/2007 Harris ..... A61H 1/024 482/148
2007/0239086 A1 * 10/2007 Ewell ..... A61H 7/001 601/15
2010/0185128 A1 * 7/2010 Galvez Campos .. A61H 1/0288 601/135
2013/0023807 A1 * 1/2013 Hennessey ..... A61H 7/003 601/119
2013/0226052 A1 * 8/2013 Niggemann ..... A61H 15/0092 601/118
2013/0237888 A1 9/2013 Weinstein
2013/0253391 A1 * 9/2013 Brahmbhatt ..... A61B 17/50 601/154
2014/0046227 A1 2/2014 Fleming
2014/0200490 A1 * 7/2014 Kie ..... A61H 1/024 601/5
2014/0350445 A1 * 11/2014 Lok ..... A61H 7/007 601/137
2016/0213554 A1 * 7/2016 Possemato ..... A61H 15/0092
2016/0296415 A1 * 10/2016 Cross ..... A61H 15/0092
2017/0340511 A1 * 11/2017 O'Keefe ..... A61H 15/00
2017/0354567 A1 * 12/2017 Shih ..... A61H 7/003

* cited by examiner

MASSAGE APPARATUS

CROSS-REFERENCE TO RELATED APPLICATIONS

This application is a claims the benefit of provisional Application No. 62/376,327, filed Aug. 17, 2016, the contents of which are hereby incorporated by reference in its entirety.

BACKGROUND OF THE INVENTION

Field of the Invention

The present invention generally relates to an apparatus for applying pressure to a person, and more particularly to an apparatus to assist in a massage.

Discussion of the Background

Massage is typically performed by applying pressure to the body of a patient, either manually or using a massage tool. Massage tools typically include some manner of surface or feature that is designed to contact the patient's body for the purpose of manipulating the patient's muscle tissue or connective tissue.

It is common for people to massage their own arms or legs to release tension in the muscles. When massaging one's own body, however, such as by applying pressure to one's own soft tissue, it is difficult to apply pressure to a trigger point (i.e. a muscle knot) without tensing the muscles.

A vast array of massage tools have been used in the past. Many previously-used tools are awkward to hold and thus difficult to use. In addition, such tools do not resolve the problem of the user tensing their own muscles to use the tools, and thus they are not as effective as they might be.

There is a need for a massage tool that is easy to manipulate, comfortable to hold, and which is versatile. There is also a need for a massage tool that a user may use to apply forces more selectively to specific parts of the body by pinpointing pressure and massage target areas with a minimal amount of effort by the user.

BRIEF SUMMARY OF THE INVENTION

The present invention overcomes the disadvantages of prior art by providing a device that allows a user to accurately apply a force to the body.

One embodiment provides an apparatus for massaging a user, where the apparatus includes a body having a handle and a distal end, and a support movably attached to the body and having a surface. The apparatus is sized to accept the user such that the distal end and the surface both contact part of the user. A force is applied to the user by the distal end and the surface being adjusted by moving the handle relative to the user.

Another embodiment provides an apparatus for massaging a user, where the apparatus includes a body having a handle at proximal end and a distal end to apply a force on the user; and a support movably attached to the body and having a surface. The apparatus is sized to accept the user such that the distal end and the surface both contact part of the user. A force is applied to the user by the distal end and the surface being adjusted by moving the handle relative to the user.

These features together with the various ancillary provisions and features which will become apparent to those skilled in the art from the following detailed description, are attained by the massage tool of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

The present invention allows a user to massage a muscle or location on their body with a desired force. Various embodiments presented herein are a device for accepting a body part between a pair of surfaces. One of the surfaces is, in several embodiments, a fixed, rotatable or twistable solid piece that is to be placed against the body part needing massaging, and the second surface may be a strap or a rigid piece that is placed against the back side of the body part. When a user places a body part between the two surfaces, and the device is moved, the body part is compressed between the two surfaces and is massaged by the first surface.

Figure 1C:
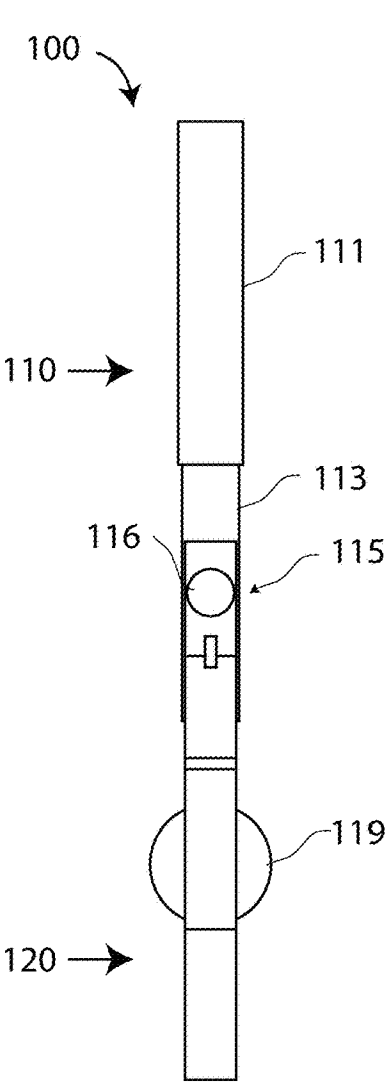
FIGS. 1A, 1B, and 1C are a front, a side, and a rear view, respectively, of a first embodiment massage tool.
Figure 1B:
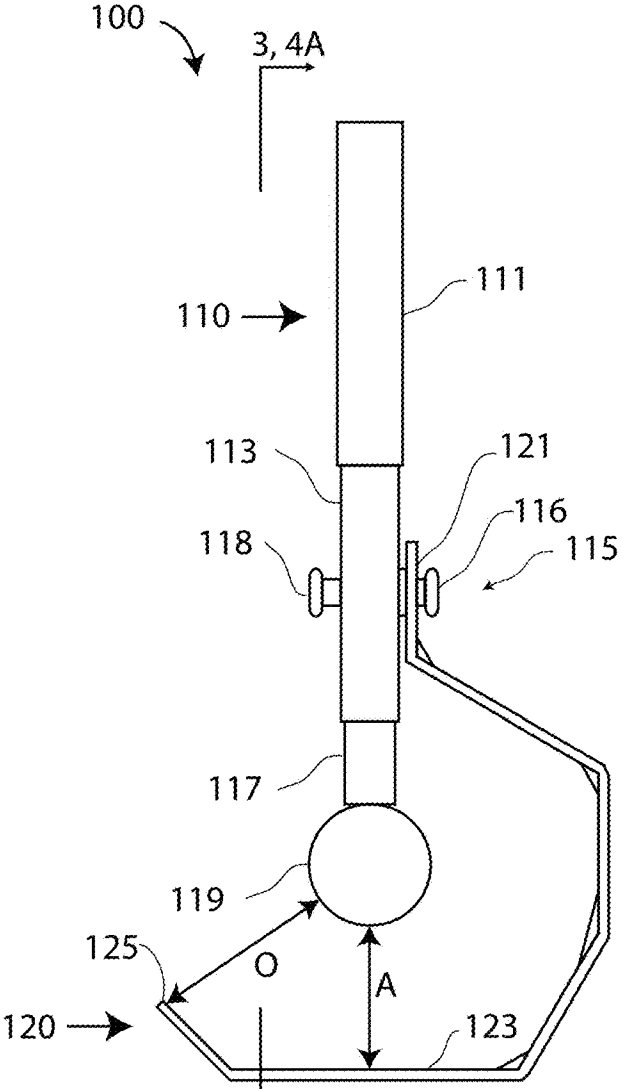
Figure 1A:
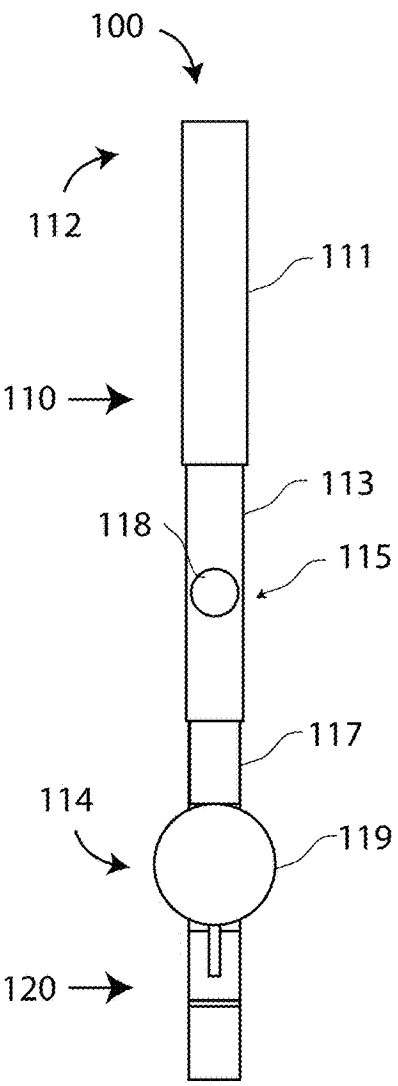
Figure 2:
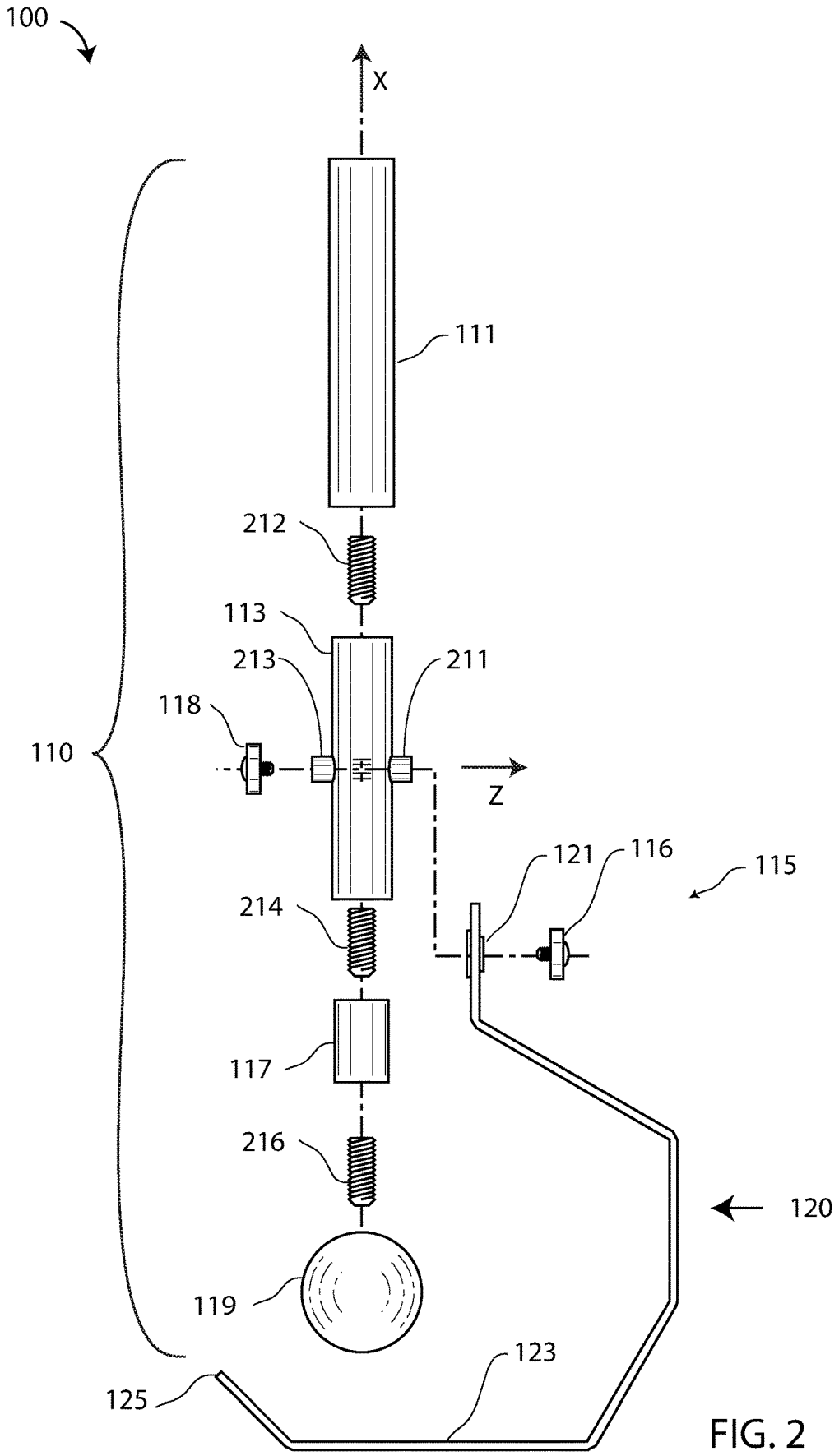
FIG. 2 is an assembly drawing of the first embodiment massage tool.

A first embodiment of the device 100 is shown in FIGS. 1A, 1B, and 1C, which are a front, a side, and a rear view, respectively, of a first embodiment massage tool 100 and in FIG. 2 as an assembly drawing of the first embodiment massage tool.

Massage tool 100 includes a body 110 and a support 120. Body 110 includes, sequentially along the axis indicated as "X." a handle 111, a central portion 113 including a pivot 115 formed by a first internally threaded portion 211 and a first thumbscrew 116, a standoff 117 and a ball-shaped tip 119, where the body extends longitudinally from a proximal end 112 at the handle to a distal end 114, which in device 100 is ball-shaped tip 119. An optional internally threaded portion 213 accepts a second thumbscrew 118 that opposes first threaded portion 211 and first thumbscrew 116. In an alternative embodiment, a number of standoffs or an adjustable length standoff may be included to adjust the various lengths, and thus the forces provided during massaging. In one embodiment, handle 111 has a length of from 4 inches to 6 inches, and ball-shaped tip 119 has a diameter of from 1.5 inches to 2 inches Support 120 is formed of metal or rigid plastic, and is generally inflexible, and has a hooked shape that extends from a bushing 121 through the support, to a portion 123, to an end 125. As shown in FIG. 1B, portion 123 is parallel to pivot 115 and is spaced by a distance A from the distal end of tip 119, and has an opening O through which a user may place an appendage, as discussed subsequently. In one embodiment, support 120 has a width of 1.5 inches, and portion 123 has a length of from 4 inches to 5 inches.

As shown in FIG. 2, the facing portions of handle 111 and central portion 113 have threaded holes (not shown) are held together with a first set screw 212. The facing portions of central portion 113 and standoff 117 have threaded holes (not shown) are held together with a second set screw 214. The facing portions of stand-off 117 and tip 119 have threaded holes (not shown) are held together with a third set screw 216. The assembly of pivot 115, which aligns along the "Z" axis, is shown as including internally threaded portion 211 of central portion 113, bushing 121 that passes through hanger 120 and first thumbscrew 116, which is sized to pass through the bushing and into threaded portion 211.

Figure 3:
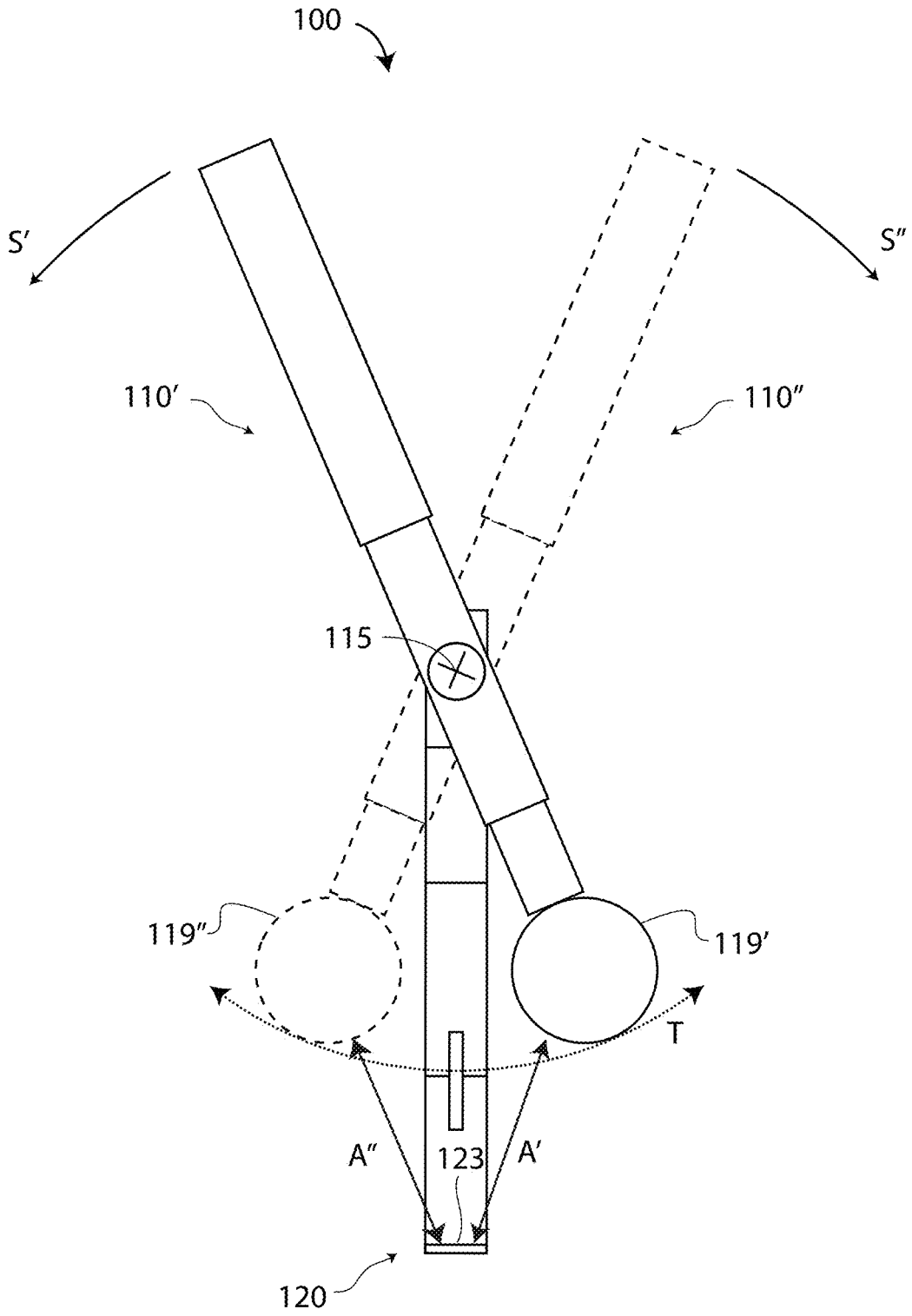
FIG. 3 is a sectional view 2-2 of two configurations of the embodiment FIG. 1B.

FIG. 3 is a sectional view 2-2 of massage tool 100 showing body 110 in an illustrative first configuration 110', obtained by rotating body 110 relative to support 120 about the Z axis of pivot 115, as indicated by arrow S', and which results in an increase in the portion 123 to distal end of tip 119 distance of A', and in an illustrative second configuration 110", which is obtained by rotating the body relative to the support about the pivot as indicated by arrow S', and which results in an increase in the portion 123 to distal end 114 distance of A". FIG. 3 also shows position of tip 119 as tip 119' and tip 119" in the first and second configurations, respectively. The arrow indicated as T shows the motion of the distal end of tip 119 relative to portion 123 as the massage tool is rotated about the pivot.

Figures 4A, 4B, 5A, 5B:
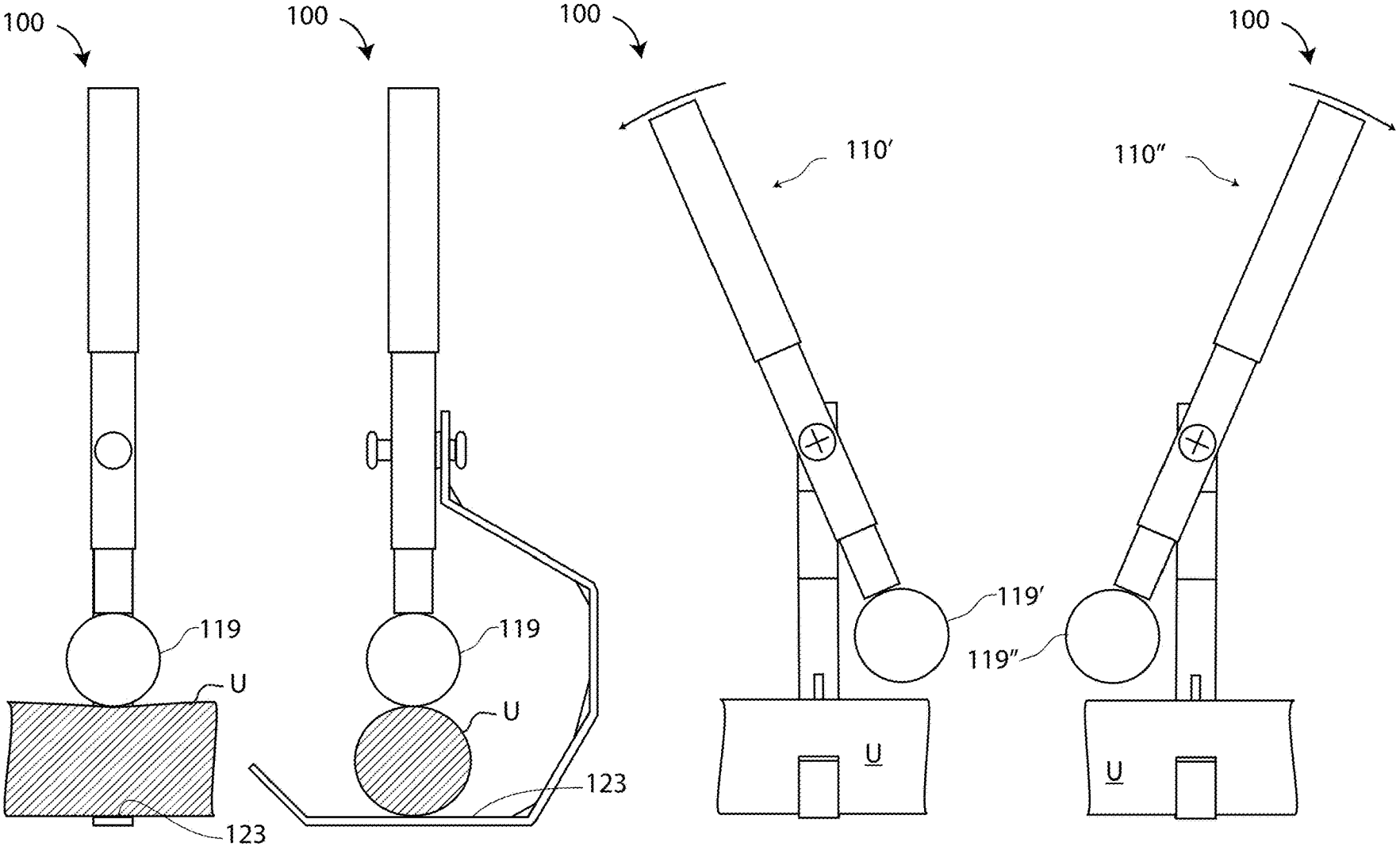
FIGS. 4A and 4B are views corresponding to FIGS. 1A and 3 when being used.
FIGS. 5A and 5B are two front views of the embodiment of FIG. 1A when being used and in different configurations.

FIGS. 4A and 4B are views corresponding to FIGS. 1A and 3 when being used as a massage tool. A portion of user U, such as an arm, hand, or leg, is placed through opening O, and between distal end 114 and portion 123.

FIGS. 5A and 5B are two front views corresponding to first configuration 110' and second configuration 110". As body 110 and support 120 are rotated about pivot 115, the distance between the distal end 114 and portion 123 changes, as shown for example in FIG. 3, imparting varying forces on a portion of user U. The length of opening O is large enough to accept an appendage of the user, such as an arm, a hand, or a foot, and the length of distance A is large enough to apply a force on the user's appendage.

Alternative Embodiments

Various alternative embodiment of massage tool 100 are discussed below. These massage tools, which provide different massage forces on the users, are generally similar to massage tool 100 in structure and use, except as explicitly discussed below.

Figure 6B:
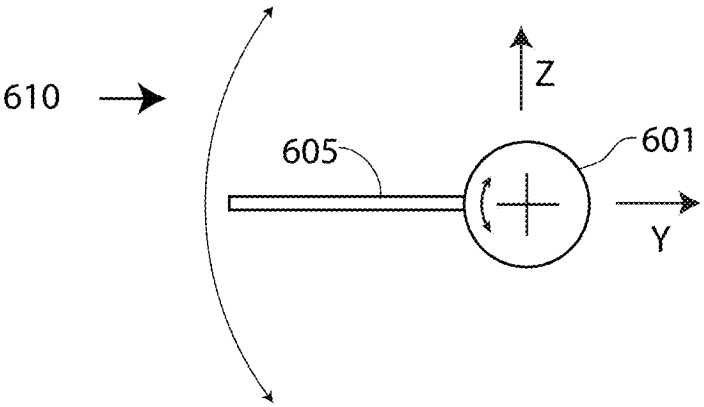
FIG. 6B is a bottom view 6B-6B of FIG. 6A.
Figure 6A:
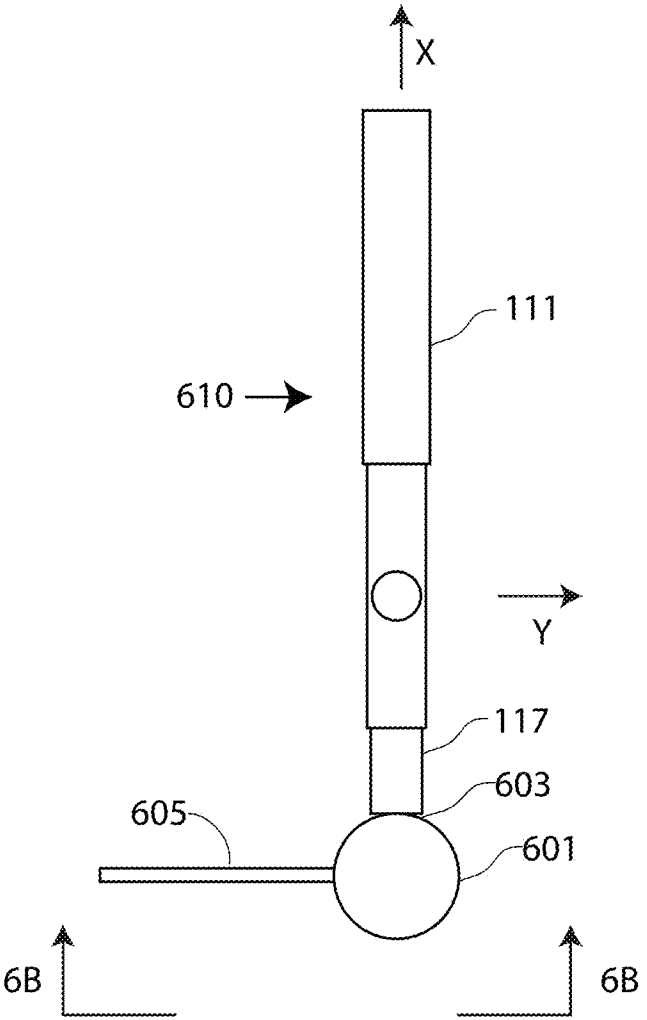
FIG. 6A is a side view of an alternative embodiment body.

FIG. 6A is a side view of an alternative embodiment body 610, and FIG. 6B is a bottom view 6B-6B of FIG. 6A. Body 610 is generally similar to body 110, except as explicitly noted and may generally be used with support 120 to form a massage tool.

Body 610 includes a ball shaped tip 601 and a rotatable mount 603 that is attached to stand-off 117 and which includes a second handle 605. As shown in FIG. 6B, handle 605 may be moved, which results in tip 601 rotating about the length of body 610, indicated as the X axis. Body 610 allows for applying pressure to the user using handle 111, as described above, while using handle 605 to rotate tip 601 back and forth.

Figure 7B:
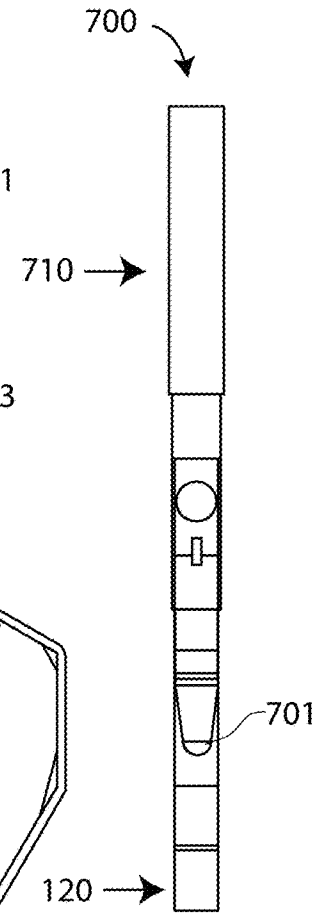
FIGS. 7A and 7B are views corresponding to FIGS. 1A and B of a second embodiment massage tool.
Figure 7A:
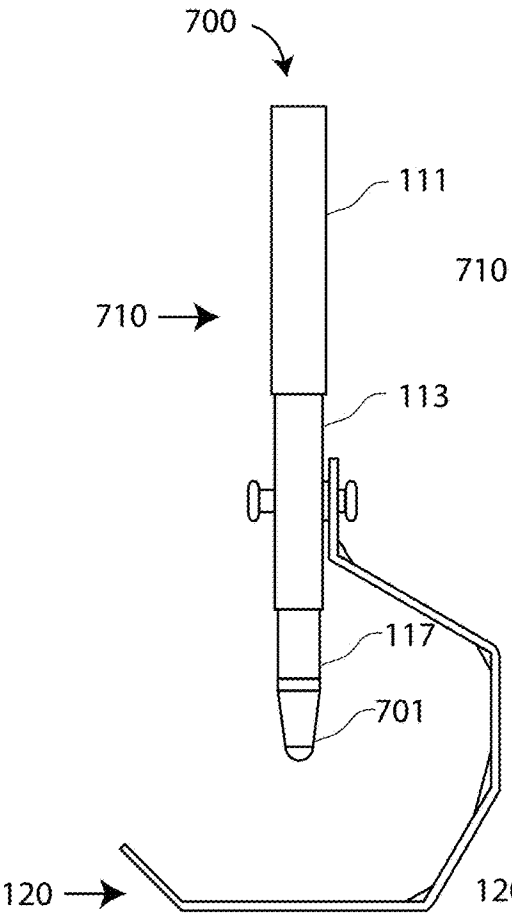

FIGS. 7A and 7B are side and front view, respectively, of a second embodiment massage tool 700, which is generally similar to massage tool 100, except as explicitly discussed below.

Massage tool 700 differs from massage tool 100, in that it includes a body 710 which is generally similar to body 110 with tip 119 replaced with a pointed tip 701 at the distal end of body 710. Massage tool 700 is thus capable of providing a more localized force to user U. In one embodiment, the diameter of tip 701 is 0.5 inches.

Figure 8B:
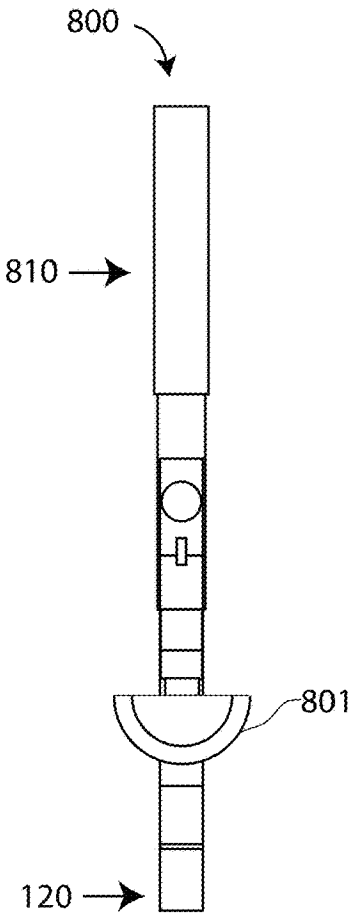
FIGS. 8A and 8B are views corresponding to FIGS. 1A and 1B of a third embodiment massage tool.
Figure 8A:
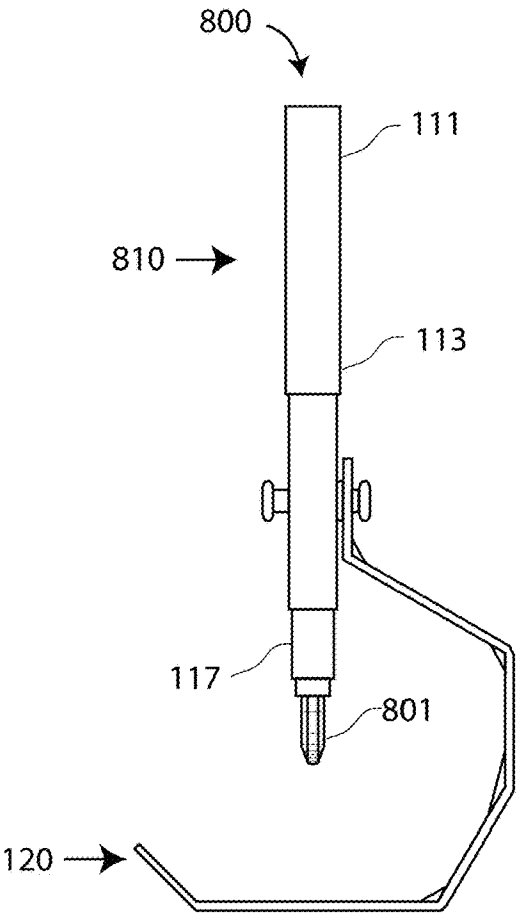

FIGS. 8A and 8B are side and front view, respectively, of a third embodiment massage tool 800, which is generally similar to massage tool 100, except as explicitly discussed below.

Massage tool 800 differs from massage tool 100, in that it includes a body 810 which is generally similar to body 110 with tip 119 replaced with a wedge-shaped tip 801. The edge-shaped tip 801 is useful in that it may to separate muscle fibers and bound tissue along an axis for a more efficient release. In one embodiment, the radius of edge-shaped tip 801 is 1.5 inches.

Figures 9A, 9B, 10A, 10B:
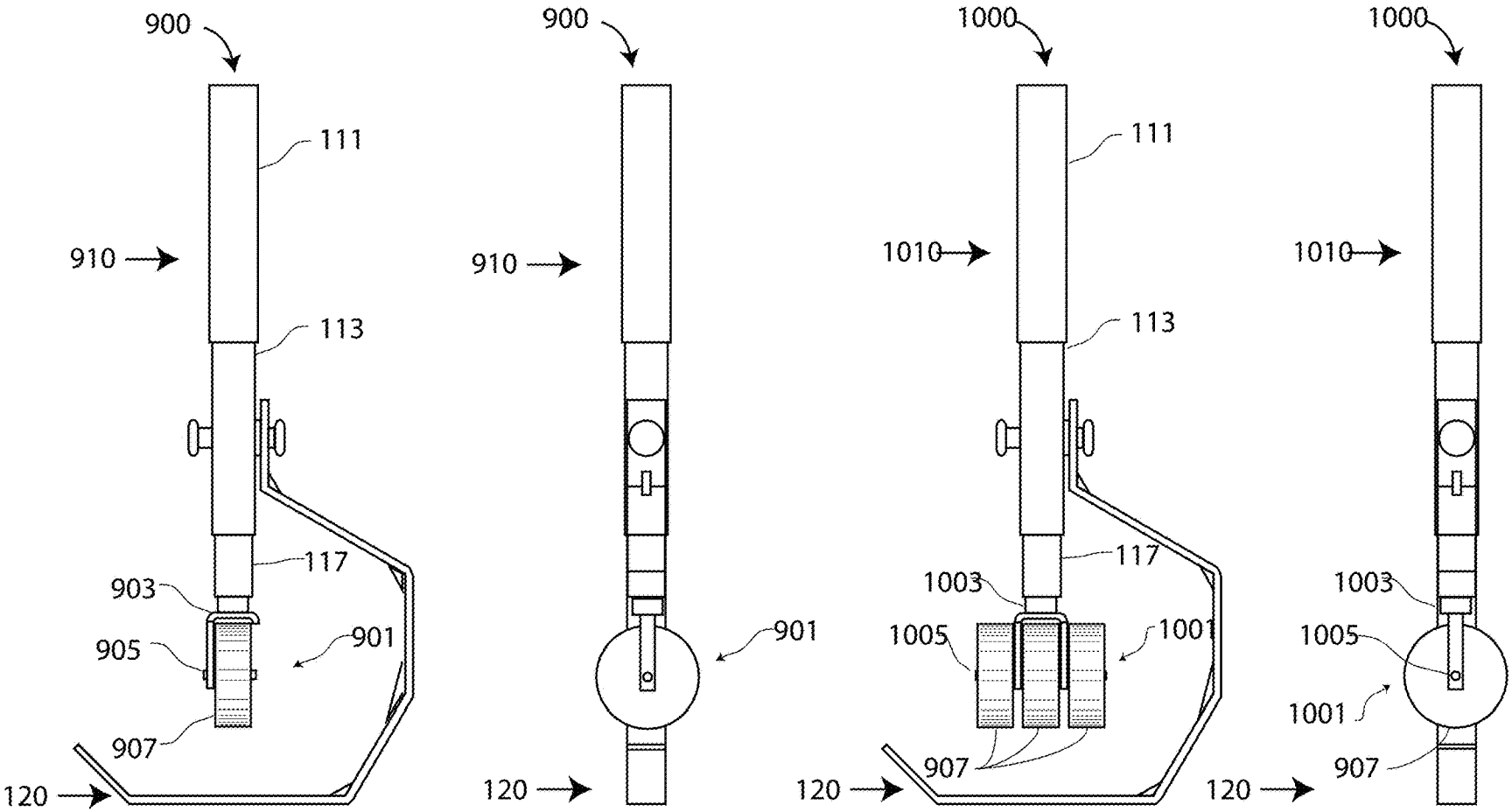
FIGS. 9A and 9B are views corresponding to FIGS. 1A and 1B of a fourth embodiment massage tool.
FIGS. 10A and 10B are views corresponding to FIGS. 1A and 1B of a fifth embodiment massage tool.

FIGS. 9A and 9B are side and front view, respectively, of a fourth embodiment massage tool 900, which is generally similar to massage tools 100, 700, and 800, except as explicitly discussed below.

Massage tool 900 differs from massage tool 100, in that it includes body 910 which is generally similar to body 110, with a roller assembly 901 in place of tip 119. Roller assembly 901 includes a bracket 903 attached to stand off 117. Bracket 903 supports a wheel 907 that is attached by axil 905 to bracket 903. Massage tool 900 also differs from massage tools 100, 700, and 800 in that the rollers assembly at the distal end of rotates. The roller assembly 901 allows the tip to be run back and forth over the target tissue to increase blood flow and stimulate bound tissues. In one embodiment, the diameter of wheel 906 is from 1 inch to 3 inches.

FIGS. 10A and 10B are side and front view, respectively, of a fifth embodiment massage tool 900, which is generally similar to massage tools 900, except as explicitly discussed below.

Massage tool 1000 differs from massage tool 900, in that it includes body 1010 which is generally similar to body 910, with a multiple roller assembly 1001 in place of roller assembly 901. Roller assembly 1001 includes a bracket 1003 attached to stand off 117. Bracket 1003 supports three wheels 903 that are attached by axil 1005 to bracket 1003. The multiple roller assembly 1001 increases the working surface area of the device to treat a wider area.

Figure 11B:
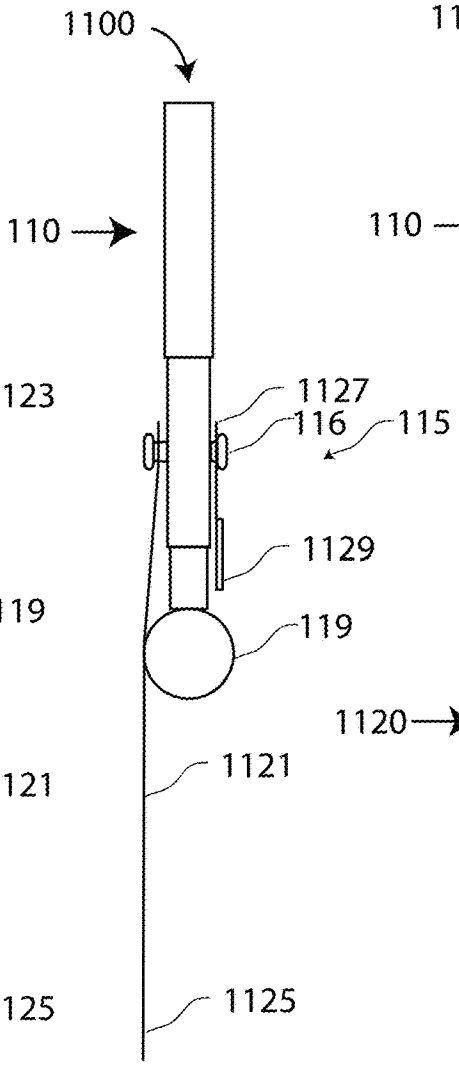
FIGS. 11A and 11B are views corresponding to FIGS. 1A and 1B of a sixth embodiment massage tool.
Figure 11A:
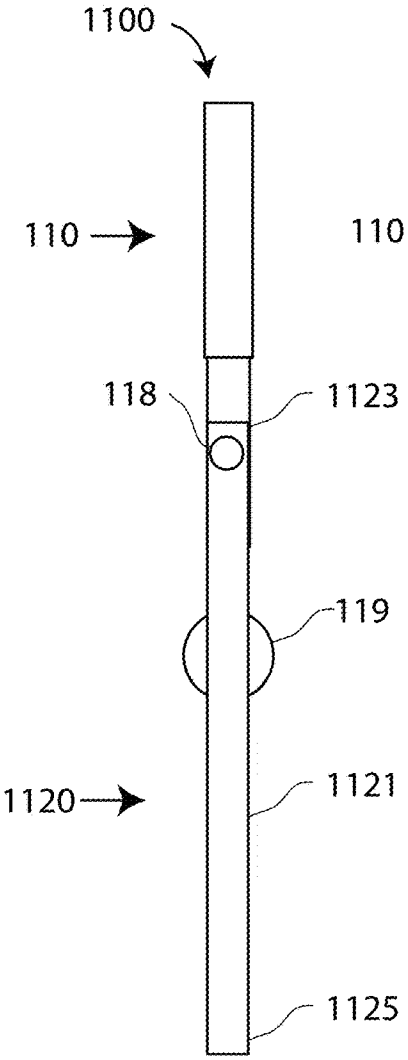

FIGS. 11A and 11B are side and front view, respectively, of a sixth embodiment massage tool 1100, which is generally similar to massage tool 100, except as explicitly discussed below.

Massage tool 1100 includes a body 110 and a strap assembly 1120 in place of support 120. Strap assembly includes a strap 1121, which may be formed of a web material, having a first end 1123 supported by second thumbscrew 118 and a second end 1125, and a buckle 1125 is supported by first thumbscrew 116 that is adapted for securing second end 1125. Strap 1121/buckle 1125 combination allows the user to adjust the tension of the strap at will. Thus, for example, varying the length and tension of the strap, different leverages can be obtained from the handle to further customize the treatment.

Figure 12B:
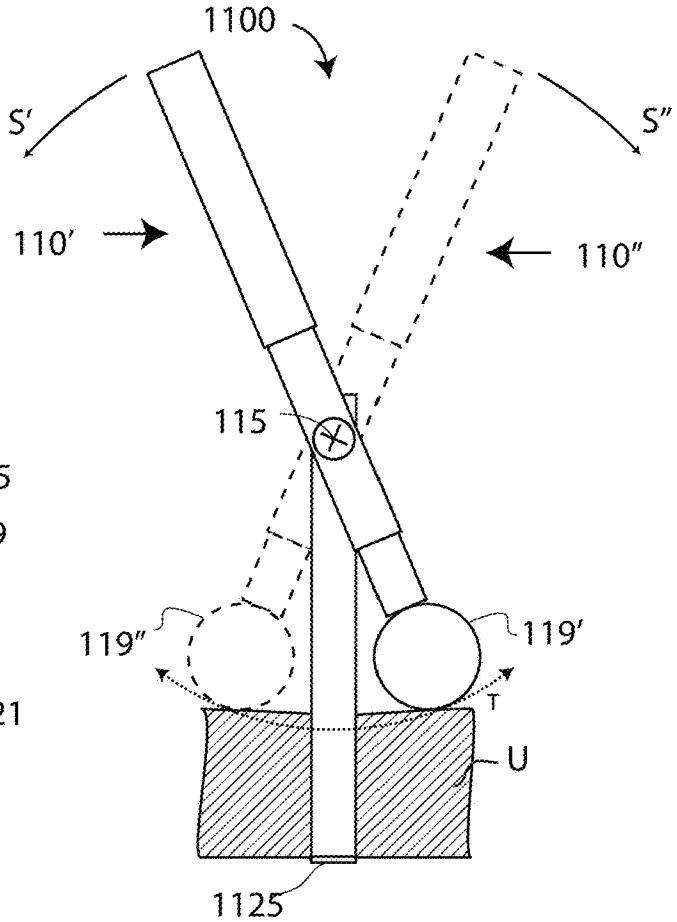
FIGS. 12A and 12B are views of the sixth embodiment massage tool in use and corresponding to the views of FIG. 4B and FIGS. 5A and 5B.
Figure 12A:
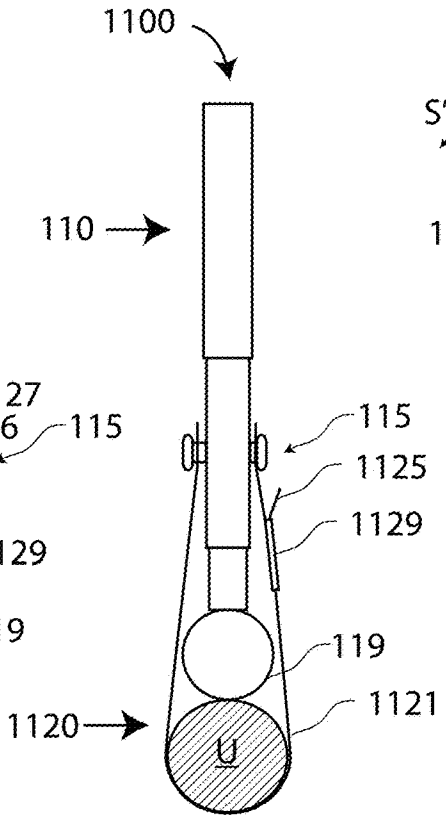

FIGS. 12A and 12B are views of the sixth embodiment massage tool 1200 in use and corresponding to the views of FIG. 4B and FIGS. 5A and 5B. The use of massage tool 1200 is generally similar to the use of massage tool 100, except as explicitly stated.

Strap 1121 is sized so that it can wrap about user U with second end 1125 secured by buckle 1129. Once a user is so secured, strap 1121 supports the user while handle 120 may be moved back and forth to massage the user, as shown in the Figures.

Figure 13B:
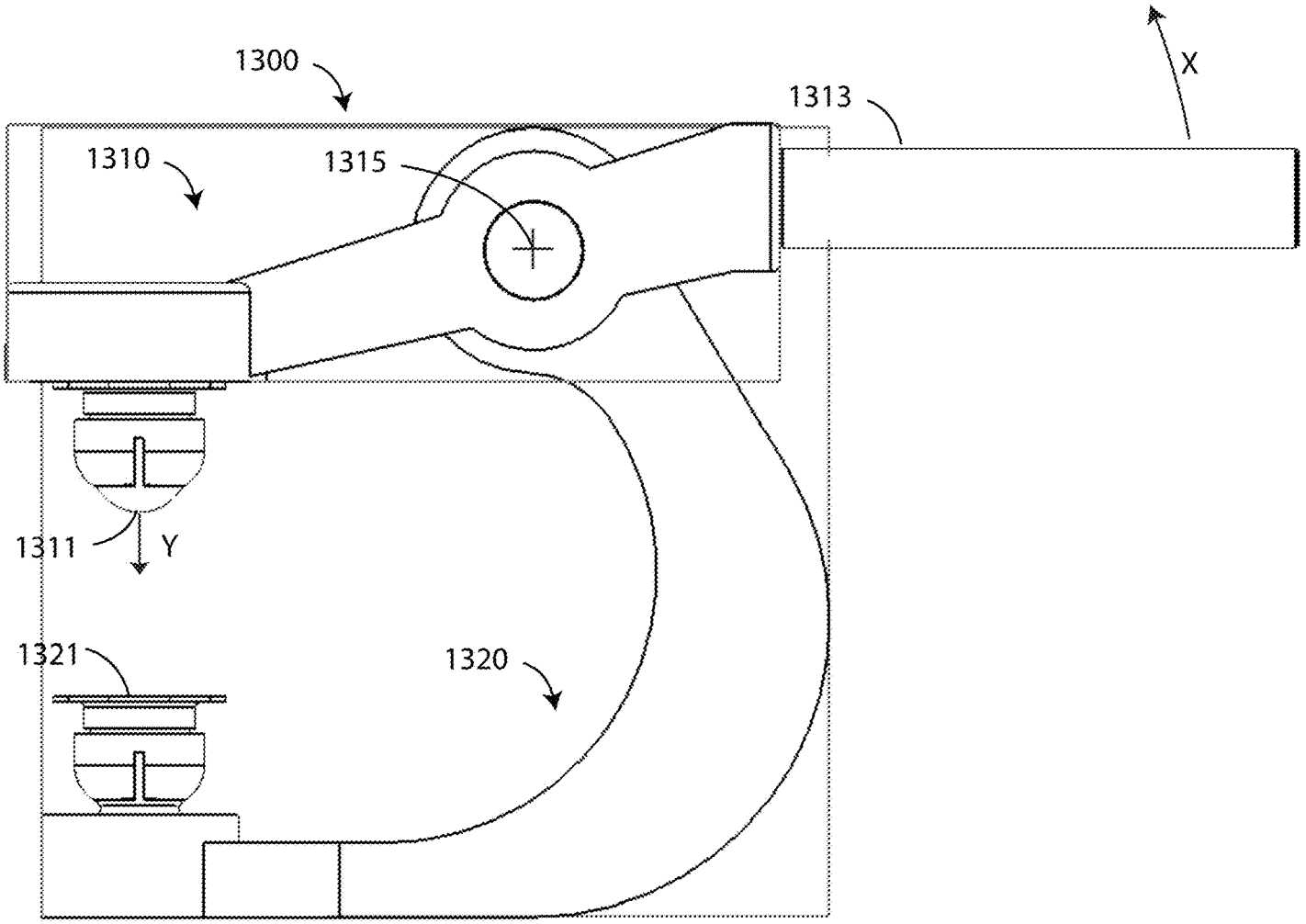
FIGS. 13A and 13B are views corresponding to FIGS. 1A and 1B of a seventh embodiment massage tool.
Figure 13A:
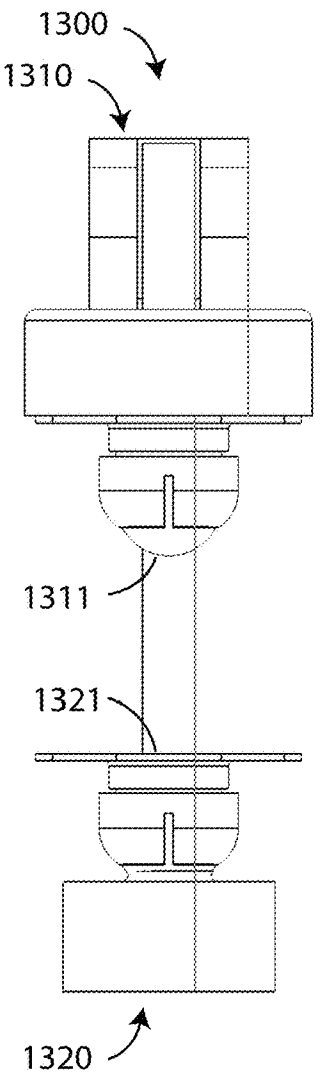

FIGS. 13A and 13B are views corresponding to FIGS. 1A and 1B of a seventh embodiment massage tool 1300, which is generally similar to massage tool 100, except as explicitly discussed below.

Massage tool 1300 includes a first body 1310 and second body 1320 that are joined about a mutual pivot 1315. First body 1310 includes a first portion 1311 and a handle 1313, and second body 1320 includes a second portion 1321 that generally faces first portion 1311. When handle 1313 is moved as shown by the arrow labeled X, first body 1310 and second body 1320 rotate about pivot 1314, and first portion 1311 moves towards second portion 1321, as indicated by the arrow labeled Y.

Figure 14:
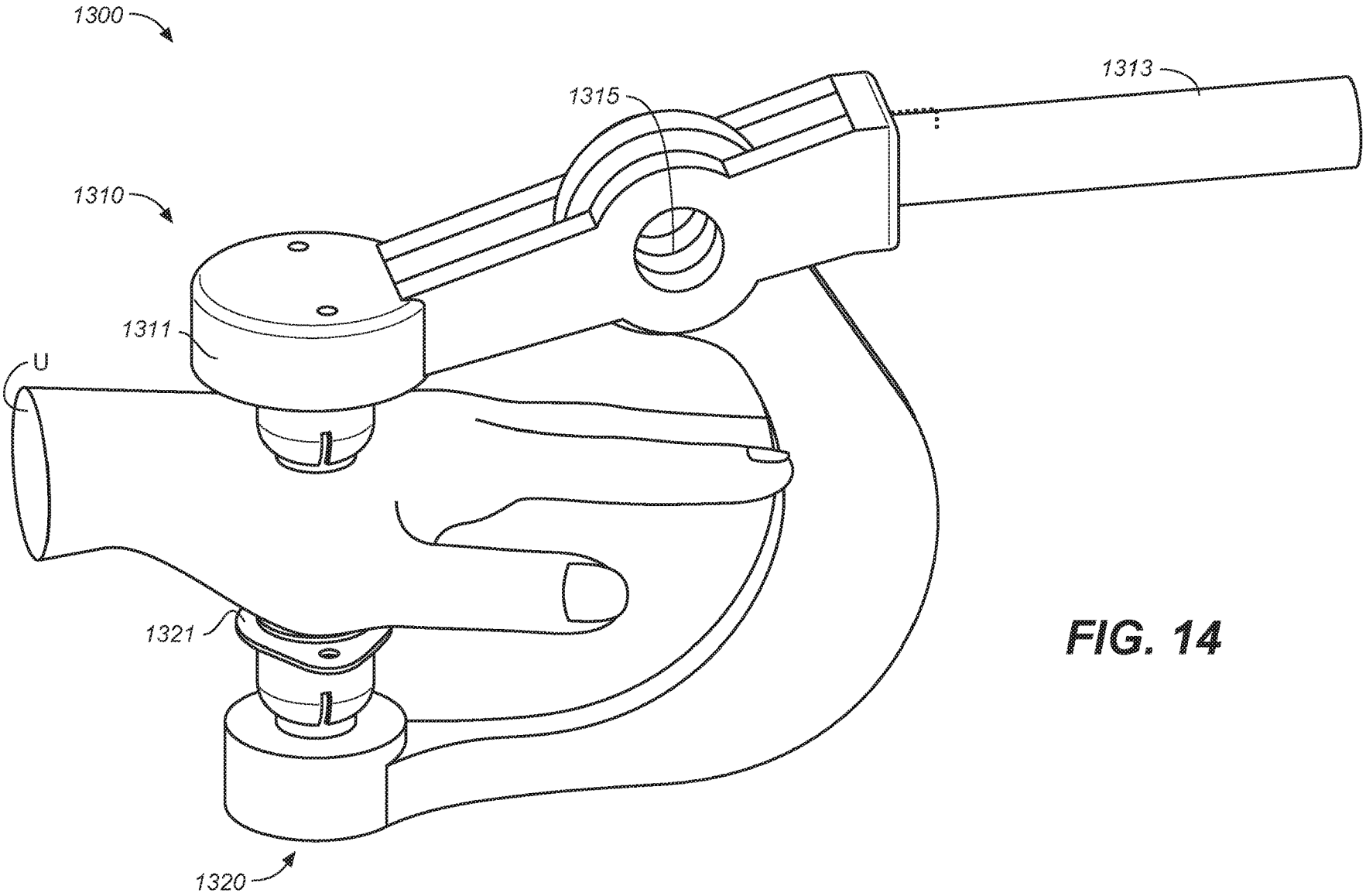
FIG. 14 is a perspective view of the seventh embodiment massage tool in use.

FIG. 14 is a perspective view of the seventh embodiment massage tool 1300 in use. The use of massage tool 1300 is generally similar to the use of massage tool 100, except as explicitly stated.

Massage tool 1300 may be sized to accept a hand, a leg, or the shoulders of a user. FIG. 14 shows the illustrative use of massage tool 1300 accepting the hand of user U as being placed between first portion 1311 and second portion 1321. The force on user n is then determined by the moving handle 1313 relative to second body 1320.

In various embodiments, portions 1311 and/or 1313 are interchangeable, which provides flexibility in which body portions of the user are massaged.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

I claim:

1. A handheld apparatus for massaging a user comprising a linear and elongate body having a proximal end and a distal end, wherein a length of the linear and elongate body extends from the proximal end to the distal end, wherein the proximal end of the linear and elongate body is connected to a handle, the linear and elongate body having a longitudinal body axis, wherein the distal end of the linear and elongate body is coupled to a proximal end of a massage sphere or massage wheel; and a support rotatably attached to the linear and elongate body at an attachment point at a first distance from a distal end of the massage sphere or massage wheel, where the support rotates about a support rotation axis that is perpendicular to the longitudinal body axis, where the support is hook shaped and includes a planar surface at a second distance from the attachment point, where the second distance is greater than the first distance, such that when the planar surface is rotated to intersect the longitudinal body axis, the longitudinal body axis is normal to the planar surface and a gap between the planar surface and the distal end of the massage sphere or massage wheel along the longitudinal body axis comprises a distance that is equal to the second distance minus the first distance, such that when the apparatus accepts a part of the user between the distal end of the massage sphere or massage wheel and the planar surface during operation of the apparatus, the distal end of the massage sphere and massage wheel and the planar surface contact the part of the user at different distances along the longitudinal body axis, and such that when the handle is moved relative to the support, a force along the longitudinal body axis is applied to the part of the user by the distal end of the massage sphere or the massage wheel and the planar surface.

2. The handheld apparatus of claim 1, where said massage sphere or massage wheel is removable from said linear and elongate body.

3. The handheld apparatus of claim 1, where said massage wheel has an axis of rotation perpendicular to the longitudinal body axis.

4. The handheld apparatus of claim 1, where said massage sphere includes an element and the element is rotatable with respect to the linear and elongate body.

* * * * *